United States Patent [19]

Hickman

[11] Patent Number: 4,488,384

[45] Date of Patent: Dec. 18, 1984

[54] ROOF EDGE CONSTRUCTION

[75] Inventor: John B. Hickman, Asheville, N.C.

[73] Assignee: W. P. Hickman Co., Asheville, N.C.

[21] Appl. No.: 256,893

[22] Filed: Apr. 23, 1981

[51] Int. Cl.[3] ..... E04D 13/5

[52] U.S. Cl. ..... 52/60; 52/94

[58] Field of Search ..... 52/94, 95, 60, 300, 52/97, 96, 573

[56] References Cited

U.S. PATENT DOCUMENTS

| | | | |
|---|---|---|---|
| Re. 26,056 | 7/1966 | Hickman | 52/94 |
| 164,602 | 6/1875 | Shepard . | |
| 674,379 | 5/1901 | Hard . | |
| 1,299,425 | 4/1919 | Carpenter . | |
| 1,337,840 | 4/1920 | Hawley . | |
| 1,740,753 | 12/1929 | Vallas . | |
| 1,782,246 | 11/1930 | Schneider . | |
| 2,136,122 | 11/1938 | Almdale . | |
| 2,160,758 | 5/1939 | Schurman . | |
| 2,219,992 | 10/1940 | Hanson . | |
| 2,250,548 | 7/1941 | Ness . | |
| 2,734,602 | 2/1956 | Dawson . | |
| 2,755,484 | 7/1956 | Hotz . | |
| 2,793,403 | 3/1953 | Livingston . | |
| 2,855,776 | 10/1958 | Trostle . | |
| 2,857,861 | 10/1958 | Trostle . | |
| 3,012,376 | 12/1961 | Reddy et al. . | |
| 3,024,573 | 3/1962 | McKinley . | |
| 3,090,161 | 5/1963 | Edwards . | |
| 3,237,352 | 3/1966 | Edwards . | |
| 3,389,515 | 6/1968 | Hellebrand . | |
| 3,405,485 | 10/1968 | Edwards . | |
| 3,415,020 | 12/1968 | Windle . | |
| 3,444,658 | 5/1969 | Gobel . | |
| 3,447,273 | 6/1969 | Thom . | |
| 3,488,902 | 1/1970 | Gobel . | |
| 3,503,162 | 3/1970 | Ward | 52/94 |
| 3,533,201 | 10/1970 | Tyler | 52/94 |
| 3,571,992 | 3/1971 | Comiskey . | |
| 3,608,255 | 9/1971 | Chomes . | |
| 3,624,973 | 12/1971 | Attaway . | |
| 3,668,811 | 6/1972 | Pollard | 52/60 |
| 3,696,575 | 10/1972 | Armstrong . | |
| 3,712,003 | 1/1973 | Hallock et al. . | |
| 3,719,010 | 3/1973 | Hickman . | |
| 3,731,439 | 5/1973 | Hickman . | |
| 3,742,668 | 7/1973 | Oliver . | |
| 3,812,634 | 5/1974 | Resech | 52/741 |
| 4,037,372 | 7/1977 | Patry . | |
| 4,071,987 | 2/1978 | Hickman | 52/94 |
| 4,241,549 | 12/1980 | Hall et al. . | |

FOREIGN PATENT DOCUMENTS

| | | |
|---|---|---|
| 1509147 | 11/1969 | Fed. Rep. of Germany . |
| 1659340 | 1/1971 | Fed. Rep. of Germany . |
| 1933004 | 1/1971 | Fed. Rep. of Germany . |
| 2060292 | 6/1972 | Fed. Rep. of Germany . |
| 2118981 | 10/1972 | Fed. Rep. of Germany . |
| 2234975 | 2/1974 | Fed. Rep. of Germany . |
| 2316266 | 10/1974 | Fed. Rep. of Germany . |
| 2335223 | 1/1975 | Fed. Rep. of Germany . |
| 1128360 | 8/1956 | France . |
| 7610357 | 4/1977 | Netherlands . |
| 7432 | of 1911 | United Kingdom . |
| 1024071 | 3/1966 | United Kingdom . |
| 1104027 | 2/1968 | United Kingdom . |
| 1203344 | 8/1970 | United Kingdom . |
| 1347974 | 2/1974 | United Kingdom . |

OTHER PUBLICATIONS

Hickman, Aluminum Construction Products, 1980.

Braas & Co. GmbH brochure entitled "PVC flat-roof systems", (date unknown), 10 pages.

Braas Systems, Inc. brochure number 1004NA, entitled "Purpose-made accessories for Braas Flat Roofs", dated 1/81 and 7/79, 10 pages.

*Primary Examiner*—Alfred C. Perham

*Attorney, Agent, or Firm*—Harness, Dickey & Pierce

[57] ABSTRACT

An improved roof edge structure of the type providing a gravel stop and a water dam around the periphery of a roof deck is described. The roof edge structure features a novel cant securing assembly which includes a cant member and a retainer member. The cant member has a flange portion adapted for flush surface engagement with a top surface of the roof deck, an inclined sheet portion sloping upwardly from the flange portion generally toward the edge of the roof deck, and a generally vertical sheet portion turned downwardly from the inclined sheet portion. The retainer member is adapted to be fastened to the top surface of the roof deck and has a securing means for confining the movement of at least the vertical sheet portion of the cant member.

17 Claims, 10 Drawing Figures

FIG. 1.
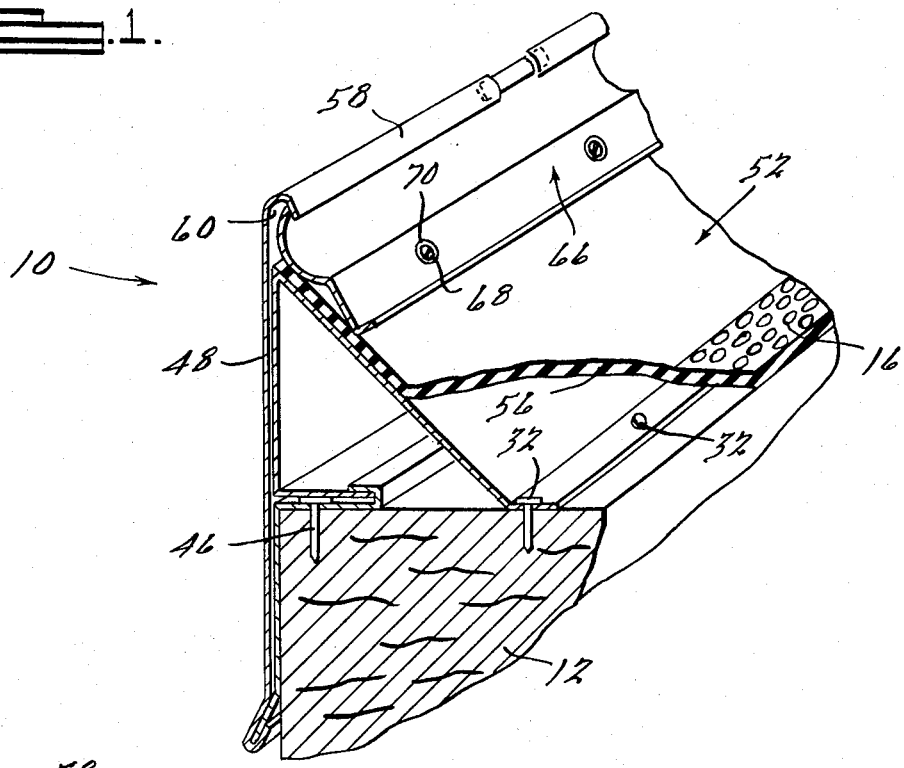
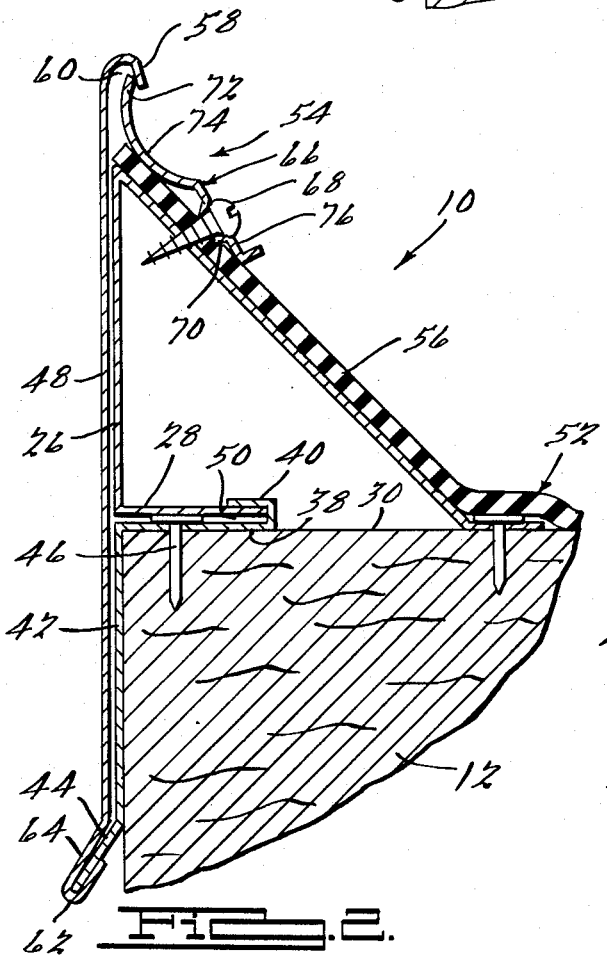
FIG. 2.
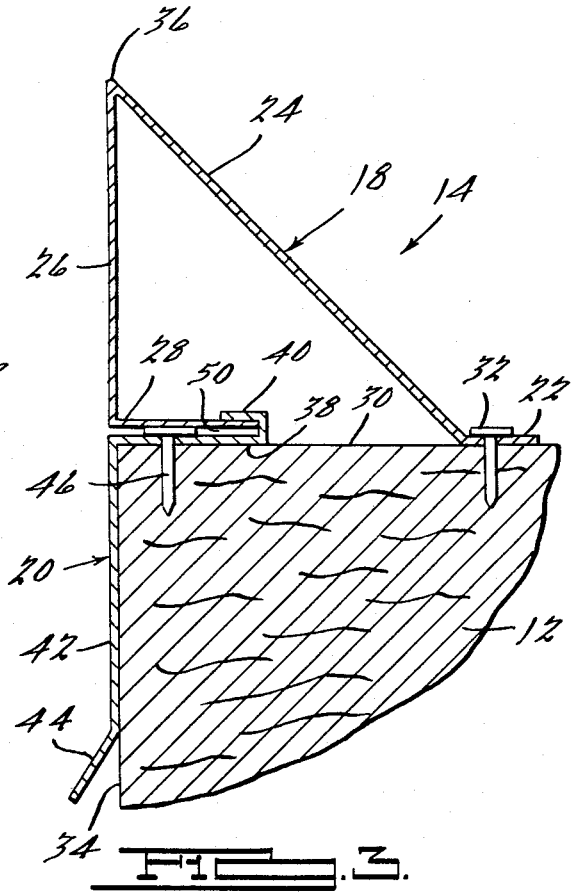
FIG. 3.

ROOF EDGE CONSTRUCTION

BACKGROUND AND SUMMARY OF THE INVENTION

The present invention relates generally to building structures and particularly to building roof edge constructions of the type providing a gravel stop and a water dam around the periphery of a roof deck. Reference may be had to U.S. Pat. No. 4,071,987 and U.S. Pat. No. Re. 26,056, both owned by the same assignee as the present invention, for a detailed description of the above-identified type of roof edge construction. The disclosures of these two patents are hereby incorporated in this application by reference.

The present invention is directed to improving the safety associated with installing and fastening roof edge structures on the roof of a building. With present roof edge structures of the above-identified type, at least one part of the roof edge structure is fastened to the face of the building. For example, in the roof edge construction described in U.S. Pat. No. Re. 26,056 the vertical leg of a cant member is nailed to the face of the building.

Accordingly, the installer must either utilize a ladder or scaffold or lean over the edge of the building to fasten the cant member to the building face. Use of a ladder or scaffold may increase the time necessary to install the roof edge structure around the periphery of the roof deck. This is considered undesirable because the risk of injury or accident may be increased if the installer elects to lean over the edge of the building roof to install the roof edge structure.

Either present method may, therefore, involve greater installation time and/or risk of injury, which is increased proportionately when multi-piece roof edge assemblies are to be installed.

Accordingly, it is a principle object of the present invention to provide an improved roof edge structure which eliminates the need for a contractor to lean over the edge of a building roof in order to install the roof edge structure around the periphery of the roof deck.

In general, the roof edge structure according to the present invention contemplates the use of a cant securing assembly which needs only be fastened to the top surface of the roof deck. The cant securing assembly includes an elongated cant member and an elongated retainer member. Specifically, the cant member is comprised of a flange portion adapted for flush surface engagement with a top surface of the roof deck, an inclined sheet portion sloping upwardly from said flange portion generally toward the edge of the roof deck, and a generally vertical sheet portion turned downwardly from said inclined sheet portion. The retainer member is adapted to be fastened to the top surface of the roof deck and includes securing means for confining the movement of at least the vertical sheet portion of the cant member.

Several different embodiments of the present invention are described herein, as will be explained in more detail below. For example, the flange portion of the cant member may itself be fastened to the top surface of the roof deck or held in surface engagement by the retainer member. Additionally, the retainer member may include a generally vertical portion turned downwardly along the face of the building of side surface of the roof deck, and a flange portion sloping outwardly and downwardly from the vertical portion for engagement with a facia member of the roof edge structure.

Additional advantages and features of the present invention will become apparent from a reading of the detailed description of the preferred embodiments which makes reference to the following set of drawings in which:

BRIEF DESCRIPTION OF THE DRAWINGS

FIG. 1 is a vertical sectional view, in perspective, showing a first embodiment of the present invention illustrated on an edge of a building roof deck.

FIG. 2 is a vertical sectional view of the structure illustrated in FIG. 1.

FIG. 3 is a vertical sectional view of a cant securing assembly fastened to the top surface of the roof deck, as illustrated in FIGS. 1 and 2.

DETAILED DESCRIPTION OF THE PREFERRED EMBODIMENT

Figure 4:
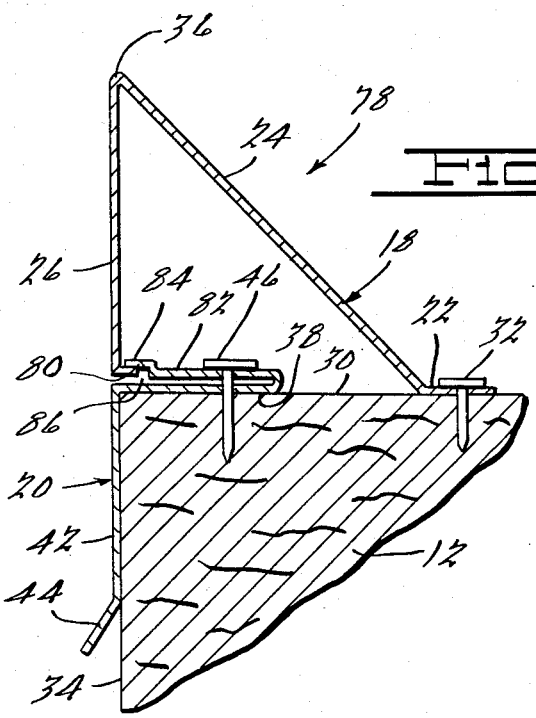
FIG. 4 is a vertical sectional view of a cant securing assembly fastened to the top surface of the roof deck according to a second embodiment of the present invention.

Referring to FIGS. 1, 2 and 3, a first embodiment of the present invention is shown. Specifically, FIGS. 1 and 2 illustrate an improved roof edge structure 10 installed on the edge of a roof deck 12. FIG. 3 illustrates a cant securing assembly 14 which forms part of the roof edge structure 10. The roof edge structure 10 provides a gravel stop and a water dam around the periphery of the roof deck 12. Accordingly, the roof edge structure 10 contains the gravel, bitumen (shown at reference numeral 16) and any water which may accumulate on the roof of the building from spilling over the sides.

The cant securing assembly 14 is generally comprised of an elongated cant member 18 and an elongated retainer member 20. The cant member 18 includes a first flange portion 22, an inclined sheet portion 24, a generally vertical sheet portion 26, and a section flange portion 28. The first flange portion 22 is adapted for flush surface engagement with a top surface 30 of the roof deck 12. The first flange portion 22 extends inwardly and generally away from the edge of the roof deck 12 and is further adapted to be fastened to the top surface 30 of the rock deck as provided by the nails 32. The inclined sheet portion 24 slopes upwardly from the first flange portion 22 and outwardly generally toward the edge of the roof deck 12. The inclined sheet portion 24 extends generally to the edge of the roof deck 12 which is defined by a side surface 34 of the roof deck 12. However, it should be appreciated that the inclined sheet portion 24 may extend beyond the edge of the roof deck 12 or may only extend substantially to this edge in the appropriate application. The vertical sheet portion 26 is turned downwardly from the inclined sheet portion 24 along an adjoining edge 36, and extends substantially the height of the cant member 18. The second flange portion 28 of the cant member 18 extends inwardly from the vertical sheet portion 26 for cooperating with a securing means of the retainer member 20 to confine the movement of the vertical sheet portion of the cant member 18.

The retainer member 20 includes a horizontal sheet portion 38, a return bent edge portion 40, a generally vertical sheet portion 42, and an inclined flange portion 44. The horizontal sheet portion 38 is adapted to be fastened to the top surface 30 of the roof deck 12, as provided by the nails 46, and has a width substantially equal to the second flange portion 28 of the cant member 18. The vertical sheet portion 42 is turned downwardly from the horizontal sheet portion 38 along the side surface 34 of the roof deck 12. It should be noted that the vertical sheet portion 42 is positioned generally flush against the side surface 34 but is not fastened to it. The inclined flange portion 44 slopes outwardly and downwardly from the vertical sheet portion 42 for engaging a facia member 48 of the roof edge structure 10. The securing means of the retainer member 20 is represented by the return bent edge portion 40. The return bent edge 40 extends from said horizontal sheet portion 38 to form at least in part a channel 50 for receiving the second flange portion 28 of the cant member 18. Accordingly, the second flange portion 28 of the cant member 18 extends generally parallel to the horizontal sheet portion 38 of the retainer member 20 and is held in the channel 50 formed by the horizontal sheet portion 38 and the return bent edge portion 40. Thus, one end of the cant member 18 as represented by the first flange portion 22 is fastened to the roof deck 12, while the other end of the cant member as represented by the second flange 28 is confined by the securing means of the retainer member 20. It should be understood that the securing means of the retainer member 20 holds the vertical sheet portion 26 of the cant member 18 in position, or in other words confines or restricts the movement of the vertical sheet portion of the cant member.

As illustrated in FIGS. 1 and 2, the roof edge structure 10 also includes the facia member 48, roofing material 52, and a clamping means generally indicated at reference numeral 54. The roofing material 52 is laid over the roof deck 12 and has a marginal portion 56 overlying the inclined portion 24 of the cant member 18. The roofing material 52 may be comprised of one or more layers of a resilient plastic, tar paper, or the like. The facia member 48 extends generally parallel to both the vertical sheet portion 26 of the cant member 18 and the vertical sheet portion 42 of the retainer member 20, and helps prevent cant member 18 from slipping out of retrainer member 20. The facia member 48 includes an upper edge portion 58 forming a downwardly opening channel 60 above the cant member 18, and a lower edge portion 62 forming an upwardly opening channel 64 for receiving the inclined flange portion 44 of the retainer member 20. The clamp means 54 includes a flexible rocker flashing 66, and a plurality of screws 68 and washers 70. The clamp means 54 is used to seal the marginal portion 56 of the roofing material 52 and for holding the facia member 48 in position. The flashing 66 includes an upper edge 72 projecting into the channel 60, an intermediate portion 74 pressing against the marginal portion 56 of the roofing material 52, and a securing protion 76 for fastening the flashing to the inclined sheet portion 24 of the cant member 18 as provided by the screws 68.

The roof edge structure 10 may be fastened and installed on the edge of the roof deck 12 in the following manner. First, the retainer member 20 is positioned at the edge of the roof deck 12, such that the horizontal sheet portion 38 engages the top surface 30 of the roof deck and the vertical sheet portion 42 engages the side surface 34 of the roof deck. The retainer member 20 is then fastened to the top surface 30 of the roof deck 12 by pounding the nails 46 through suitable apertures in the horizontal sheet portion 38 and into the roof deck. Then, the second flange portion 28 of the cant member 18 is inserted into the channel 50 of the retainer member. The first flange portion 22 of the cant member 18 is then fastened to the top surface 30 of the roof deck 12 by pounding the nails 32 through suitable apertures in the first flange portion and into the roof deck. However, it should be understood that in the appropriate application the first flange portion 22 of the cant member 18 may be fastened before the second flange portion 28 is inserted into the channel 50. In this situation the cant member 18 should be provided with sufficient flexibility to snap the second flange portion 28 over the return bent edge 40 and into the channel 50. The remaining parts of the roof edge structure 10 may then be assembled by conventional techniques. It should be appreciated that during the installation of the roof edge structure 10, the contractor is not required to lean over the edge of the roof deck 12 as all of the fastening steps take place over the top surface 30 of the roof deck.

Referring to FIG. 4, a second embodiment according to the present invention is shown. Specifically, a cant securing assembly 78 is illustrated. Since this embodiment contains many of the same elements as the cant securing assembly 14 of the first embodiment, corresponding elements are labeled with the same reference numerals. This procedure is also utilized in the remaining embodiments.

The cant securing assembly 78 includes a second flange portion 80 of the cant member 18 which is formed to extend inwardly and generally away from the edge of the roof deck 12, but has a width shorter than the second flange portion 28 of the first embodiment. The securing means of the retainer member is provided by a return bent sheet portion 82 extending from and generally lying over the horizontal sheet portion 38, and an elevated flange edge 84 forming at least in part a channel 86 for receiving the second flange portion 80 of the cant member 18. The second flange portion 80 and the elevated flange edge 84 are formed generally parallel to each other and to the top surface 30 of the roof deck 12. Furthermore, the elevated flange edge 84 overlaps the second flange portion 80 to lock or secure the cant member 18 to the retainer member 20. It should also be noted that the nails 46 are driven through both the horizontal sheet portion 38 and the return bent sheet portion 82 of the retainer member 20 so that both of these portions are fastened to the top surface 30 of the roof deck 12.

Figure 5:
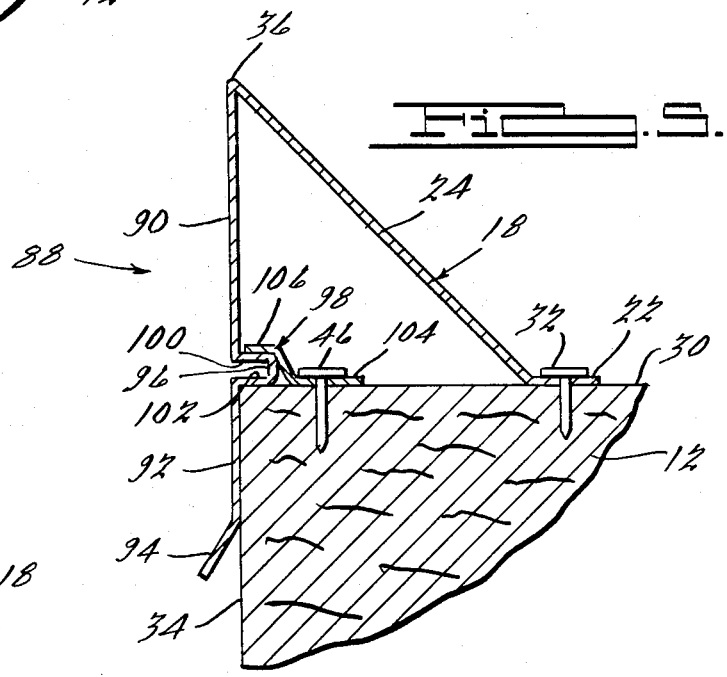
FIG. 5 is a vertical sectional view of a cant securing assembly fastened to the top surface of the roof deck according to a third embodiment of the present invention.

Referring to FIG. 5, a cant securing assembly 88 of a third embodiment according to the present invention is shown. The cant member 18 in this embodiment includes a generally vertical sheet portion 90 which extends downwardly below the top surface 30 of the roof deck 12 along the side surface 34. The vertical sheet portion 90 includes a lower section 92 and an inclined flange portion 94 which perform the same function as the vertical sheet portion 42 and inclined flange portion 44 for the retainer member 20 of the first embodiment. The vertical sheet portion 90 also includes a channel-shaped projection 96 which extends inwardly for cooperating with the securing means of a retainer member 98 to confine the movement of the vertical sheet portion 90. The channel-shaped projection 96 is formed with a pair of side walls 100 and 102 which extend generally parallel to the top surface 30 of the roof deck 12, with the side wall 102 seated in flush surface engagement with the top surface 30. The retainer member 98 includes a horizontal sheet portion 104 adapted to be fastened to the top surface 30 of the roof deck 12 as provided by the nails 46, and an elevated flange portion 106 formed with a shape generally complimentary with the channel-shaped projection 96. The elevated flange portion 106 overlaps the side wall 100 of the channel-shaped projection 96 to hold the side wall 102 into surface engagement with the top surface 30 of the roof deck.

Figure 6:
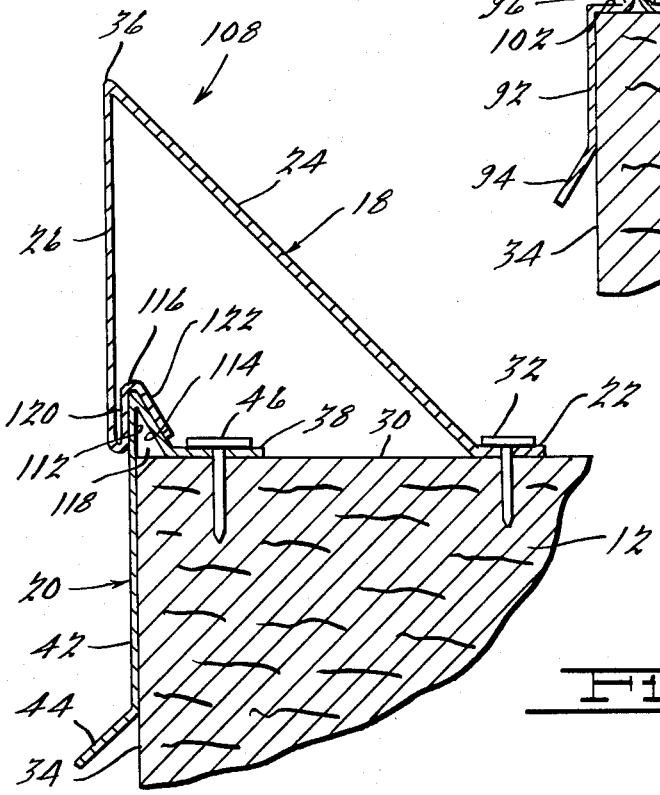
FIG. 6 is a vertical sectional view of a cant securing assembly fastened to the top surface of the roof deck according to a fourth embodiment of the present invention.

Referring to FIG. 6, a cant securing assembly 108 of a fourth embodiment according to the present invention is shown. The securing means of the retainer member 20 is provided by a channel-shaped projection extending above the horizontal sheet portion 38. The channel-shaped projection is comprised of a vertical wall 112 and an inclined wall 114, with the vertical wall 112 forming part of the vertical sheet portion 42 of the retainer member 20. The cant member 18 includes a second flange portion 116 which is formed to provide a downwardly opening channel 118 for receiving the channel-shaped projection of the retainer member 20. Accordingly, the second flange portion 116 includes a vertical wall 120 turned upwardly and inwardly from the vertical sheet portion 26 and an inclined wall 122 turned downwardly and inwardly from the vertical wall 120.

Figure 7:
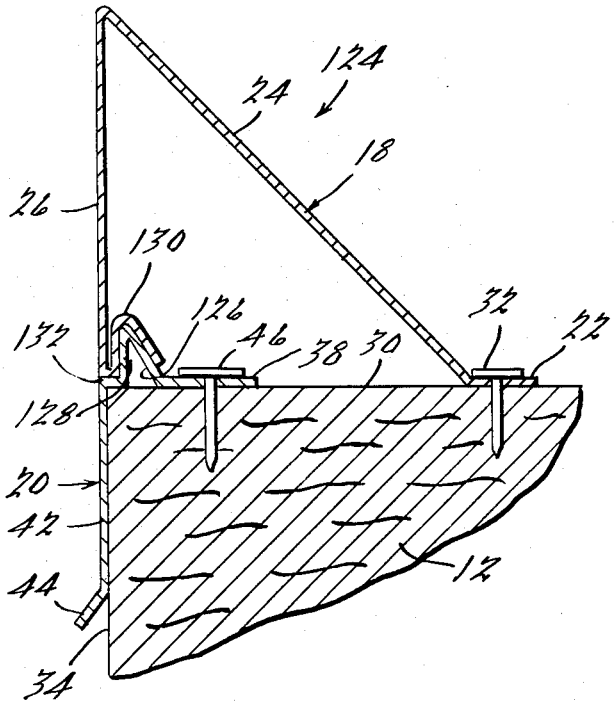
FIG. 7 is a vertical sectional view of a cant securing assembly fastened to the top surface of the roof deck according to a fifth embodiment of the present invention.

Referring to FIG. 7, a cant securing assembly 124 of a fifth embodiment according to the present invention is shown. The cant securing assembly 124 is very similar to the cant securing assembly 108, except that the cant member 18 and the retainer member 20 are formed such that the vertical sheet portion 26 of the cant member lies in substantially the same plane as the vertical sheet portion 42 of the retainer member, thereby providing a flush appearance. A channel-shaped projection 126 of the retainer member 20 is formed along the horizontal sheet portion 38 such that a vertical wall 128 of the projection is spaced from the vertical sheet portion 42. A second flange portion 130 of the cant member 18 is shaped the same as the second flange portion 116 of the fourth embodiment, except that it includes a generally flat horizontal edge 132 for engagement with the horizontal sheet portion 38 of the retainer member 20. It should be noted that in both the fourth and fifth embodiments, the securing means of the retainer member 20, as provided by the channel-shaped projections, cooperates with the second flange portion of the cant member 18 to firmly lock the cant member to the retainer member. It should also be noted that in the event water were to penetrate the roof edge structures of the fourth and fifth embodiments, it would merely run down the face of the vertical sheet portion 26 of the cant member 18 and drip off onto the face of the vertical sheet portion 42 of the retainer member 20, rather than leak back into the building.

Figure 8:
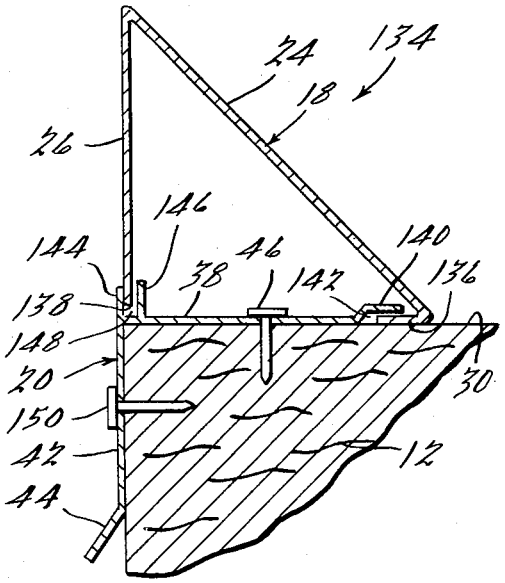
FIG. 8 is a vertical sectional view of a cant securing assembly fastened to the top surface of the roof deck according to the sixth embodiment of the present invention.

Referring to FIG. 8, a cant securing assembly 134 of a sixth embodiment according to the present invention is shown. The cant member 18 includes a first flange portion 136 which extends outwardly and generally toward the edge of the roof deck 12. The first flange portion 136 is also adapted for flush surface engagement with the top surface 30 of the roof deck 12. It should be observed that the cant member 18 of this embodiment does not include a second flange portion. Rather the vertical sheet portion 26 extends downwardly to a generally flat and edge 138. In this embodiment, as well as the remaining embodiments, the securing means of the retainer member 20 confines the movement of both the vertical sheet portion 26 and the first flange portion 136 of the cant member 18. Accordingly, the securing means includes an elevated edge portion 140 extending inwardly from the horizontal sheet portion 38 and generally parallel to the top surface 30 of the roof deck 12. The elevated edge portion 140 forms, at least in part, an inwardly opening slot 142 for receiving the first flange portion 136 of the cant member 18. Thus, the elevated edge portion 140 overlaps the first flange portion 136 of the cant member 18 to hold the first flange portion into surface engagement with the top surface 30 of the roof deck 12. The securing means of the retainer member also includes a pair of generally parallel upwardly projecting ridges 144 and 146, which form, at least in part, an upwardly opening channel 148 for receiving the end edge 138 of the vertical sheet portion 26. It should be noted that the ridge 144 also forms part of the vertical sheet portion 42 of the retainer member 20. The cant securing assembly 134 also includes one or more optional nails 150 which may be used when extra fastening is required. However, it is emphasized that the nails 150 are not necessary to the cant securing assembly 134, as the nails 46 are intended to provide all of the fastening required under normal circumstances.

Figure 9:
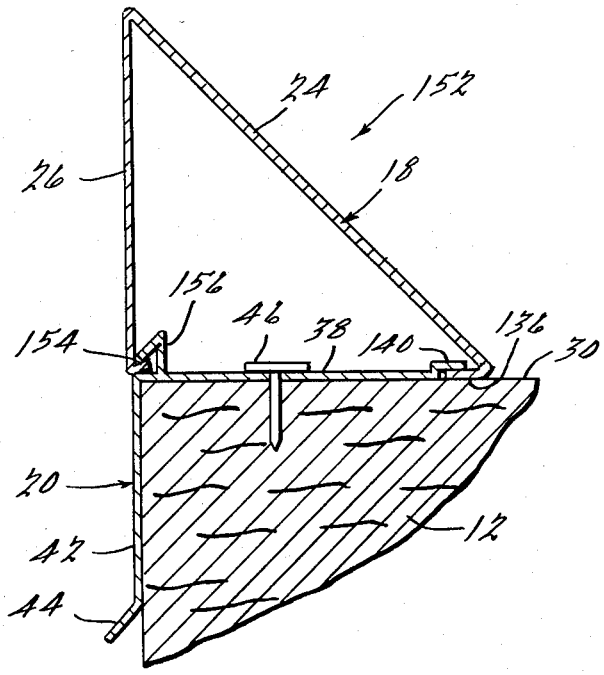
FIG. 9 is a vertical sectional view of a cant securing assembly fastened to the top surface of the roof deck according to a seventh embodiment of the present invention.

Referring to FIG. 9, a cant securing assembly 152 of a seventh embodiment according to the present invention is shown. The cant member 18 includes a second flange portion 154 which is formed to slope upwardly and inwardly from the vertical sheet portion 26. The securing means of the retainer member also includes a hook-shaped projection 156 extending above the horizontal sheet portion 38 and facing outwardly to receive the second flange portion 154 of the cant member 18 to lock the cant member to the retainer member. It should be noted that the entire cant securing assembly 152 is fastened to the roof deck 12 by only the nails 46.

Figure 10:
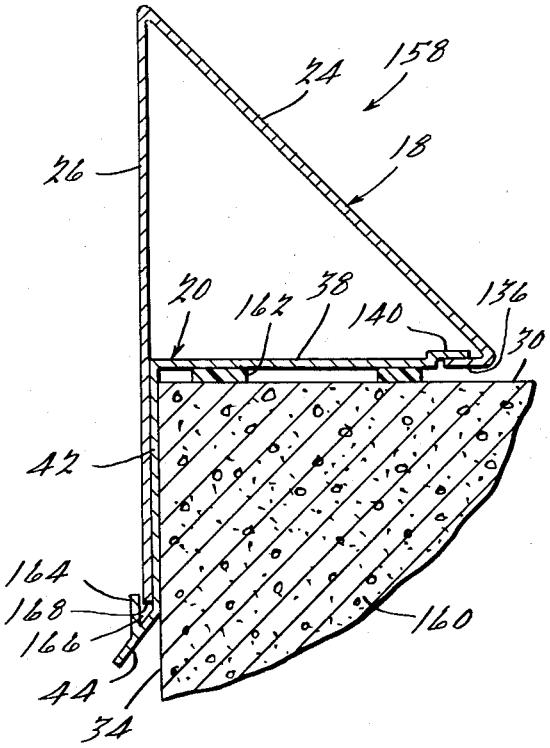
FIG. 10 is a vertical sectional view of a cant securing assembly fastened to the top surface of the roof deck according to an eighth embodiment of the present invention.

Referring to FIG. 10, a cant securing assembly 158 of an eighth embodiment according to the present invention. It should be observed that the roof deck 160 is made of a masonry construction, rather than the wood construction of the previous roof decks 12. This is to illustrate that the principles of the present invention are also applicable to various types of roof deck constructions. With a masonry construction it is preferred that a suitable adhesive or glue 162 be used to fasten or bond the horizontal sheet portion 38 of the retainer member 20 to the top surface 30 of the roof deck 160. However, other suitable fastening techniques may be used in the appropriate application. It should be appreciated that the thickness of the adhesive 162 is greatly exaggerated in FIG. 10 for illustrative purposes. The vertical sheet portion 26 of the cant member 18 extends downwardly below the top surface 30 of the roof deck 162 along the vertical sheet portion 42 of the retainer member 20. The securing means of the retainer member 20 also includes a ridge 164 projecting upwardly from the inclined flange portion 44 of the retainer member for confining the movement of the vertical sheet portion 26 of the cant member 18. The ridge 164 forms, at least in part, an upwardly opening channel 166 for receiving an end edge 168 of the vertical sheet portion of the cant member 18.

With respect to the materials used to construct the various cant securing assemblies described above, it is preferred that galvanized steel be employed for the cant members and galvanized steel or extruded aluminum be employed for the retainer members. However, other suitable materials may also be employed in the appropriate application. For the remaining parts of the roof edge structures according to the present invention, conventional materials well known in the art may be employed.

The above description relating to the fascia member and other assembly details as referred to in connection with the embodiment of FIGS. 1, 2, and 3, is also applicable to the embodiments of FIGS. 4 to 10.

The various embodiments which have been set forth above were for the purpose of illustration and were not intended to limit the invention. It will be appreciated by those skilled in the art that various changes and modifications may be made to these embodiments described in this specification without departing from the spirit and scope of the invention as defined by the appended claims.

What is claimed is:

1. A cant securing assembly for a roof edge structure of the type forming a raised edge structure or gravel stop and a water dam around the periphery of a roof deck comprising:

an elongated cant member having a flange portion adapted for flush surface engagement with a top surface of said roof deck, an inclined sheet portion sloping generally upwardly from said flange portion and generally toward the edge of said roof deck when said cant member is positioned on said roof deck, and a generally vertical sheet portion turned downwardly from said inclined sheet portion and extending downwardly to a position at least generally adjacent said top surface of said roof deck when said cant member is positioned thereon; and an elongated retainer member including a horizontal sheet portion adapted to be fastened to said top surface of said roof deck and including a generally vertical sheet portion turned downwardly from said horizontal sheet portion and adapted to be positioned along an outer vertical face surface of said roof deck when said retainer member is fastened to the top surface thereof, and having securing means for confining the movement of at least said vertical sheet portion of said cant member, said securing means including interlocking means for interlockingly attaching said vertical sheet portion of said cant member to said horizontal sheet portion of said retainer member.

2. The cant securing assembly according to claim 1 wherein said retainer member includes an inclined flange portion sloping outwardly and downwardly from said vertical sheet portion of said retainer member for engaging a facia member of said roof edge structure.

3. The cant securing assembly according to claim 2 wherein said retainer member includes nail means adapted to secure said retainer member to said top surface of said roof deck.

4. The cant securing assembly according to claim 2 wherein said retainer member includes bonding means adapted to secure said retainer member to said top surface of said roof deck by an adhesive.

5. An improved roof edge structure for forming a raised edge structure or gravel stop and a water dam around the periphery of a roof deck, comprising:

a cant securing assembly which includes an elongated cant member having a flange portion, an inclined sheet portion and a generally vertical sheet portion, and an elongated retainer member including a horizontal sheet portion adapted to be fastened to a top surface of said roof deck and including a generally vertical sheet portion turned downwardly from said horizontal sheet portion along a face surface of said roof deck, and having securing means for confining the movement of at least said vertical sheet portion of said cant member said securing means including interlocking means for interlockingly attaching said vertical sheet portion of said cant member to said horizontal sheet portion of said retainer member;

roofing material laid over said roof deck and having a marginal portion overlying said inclined portion of said cant member;

a facia member extending generally parallel to said vertical sheet portion of said cant member and having an edge portion forming a downwardly opening channel above said cant member; and clamp means for sealing said marginal portion of said roofing material and for holding said facia member in position.

6. The roof edge structure according to claim 5 wherein said flange portion of said cant member is adapted for flush surface engagement with said top surface of said roof deck, said inclined sheet portion slopes upwardly from said flange portion, and said vertical sheet portion is turned downwardly from said inclined sheet portion.

7. A cant securing assembly for a roof edge structure of the type forming a raised edge structure or gravel stop and a water dam around the periphery of a roof deck, comprising:

an elongated cant member having a flange portion adapted for flush surface engagement with a top surface of said roof deck, an inclined sheet portion sloping generally upwardly from said flange portion and generally toward the edge of sad roof deck when said cant member is positioned on said roof deck, and a generally vertical sheet portion turned downwardly from said inclined sheet portion; and an elongated retainer member including a horizontal sheet portion adapted to be fastened to said top surface of said roof deck and including a generally vertical sheet portion turned downwardly from said horizontal sheet portion and adapted to be positioned along a face surface of said roof deck when said retainer member is fastened to the top surface thereof, and having securing means for confining the movement of at least said vertical sheet portion of said cant member, said securing means of said retainer member including a pair of generally parallel upwardly projecting members for confining the movement of said vertical sheet portion of said cant member.

8. The cant securing assembly according to claim 7 wherein said retainer member includes an inclined flange portion sloping outwardly and downwardly from said vertical sheet portion of said retainer member for engaging a facia member of said roof edge structure, said vertical portion of said cant member extending downwardly below said top surface of said roof deck along said vertical sheet portion of said retainer member when said cant member and retainer member are assembled on said roof deck, and one of said upwardly projecting members comprising a ridge projecting upwardly from said flange portion of said retainer member for confining the movement of said vertical sheet portion of said cant member.

9. The cant securing assembly according to claim 8 wherein said ridge forms at least in part a channel for receiving an end of said vertical sheet portion of said cant member.

10. The cant securing assembly according to claim 7 wherein said pair of upwardly projecting members form at least in part a channel for receiving an end of said vertical sheet portion of said cant member which extends downwardly between said pair of ridges.

11. A cant securing assembly for a roof edge structure of the type forming a raised edge structure or gravel stop and a water dam around the periphery of a roof deck, comprising:

an elongated cant member having a flange portion adapted for flush surface engagement with a top surface of said roof deck, an inclined sheet portion sloping generally upwardly from said flange portion and generally toward the edge of said roof deck when said cant member is positioned on said roof deck, and a generally vertical sheet portion turned downwardly from said inclined sheet portion; and an elongated retainer member including a horizontal sheet portion adapted to be fastened to said top surface of said roof deck and including a generally vertical sheet portion turned downwardly from said horizontal sheet portion and adapted to be positioned along a face surface of said roof deck when said retainer member is fastened to the top surface thereof, and having securing means for confining the movement of at least said vertical sheet portion of said cant member, said cant member including a second flange portion which extends inwardly from said vertical sheet portion of said cant member for cooperating with said securing means of said retainer member to confine the movement of said vertical sheet portion of said cant member.

12. The cant securing assembly according to claim 11 wherein said second flange portion is formed to slope upwardly and inwardly from said vertical sheet portion of said cant member, and said retainer member includes a hook shaped projection extending upwardly from said horizontal sheet portion and facing outwardly to receive said second flange portion of said cant member and lock said cant member to said retainer member.

13. The cant securing assembly according to claim 11 wherein said securing means of said retainer member includes an inverted channel shaped member extending above said horizontal sheet portion, and said second flange portion of said cant member is formed to provide a channel complimentary in shape to said inverted channel shaped member for receiving said inverted channel shaped member of said retainer member.

14. The cant securing assembly according to claim 13 wherein one wall of said inverted channel shaped member of said securing means is provided by said vertical sheet portion of said retainer member.

15. The cant securing assembly according to claim 11 wherein said second flange portion of said cant member is formed to extend inwardly and generally parallel to said horizontal sheet portion of said retainer member, and said securing means of said retainer member includes a return bent edge portion forming at least in part a channel for receiving said second flange portion of said cant member.

16. The cant securing assembly according to claim 11 wherein said second flange portion of said cant member is formed to extend inwardly and generally away from the edge of said roof deck when said cant member is positioned thereon, said securing means of said retainer member including a return bent sheet portion extending from and generally lying over said horizontal sheet portion and having an elevated flange edge forming at least in part a channel for receiving said second flange portion of said cant member, and both said return bent and horizontal sheet portions of said retainer member being adapted to be fastened to said top surface of said roof deck.

17. A cant securing assembly for a roof edge structure of the type forming a raised edge structure or gravel stop and a water dam around the periphery of a roof deck, comprising:

an elongated cant member having a flange portion adapted for flush surface engagement with a top surface of said roof deck, an inclined sheet portion sloping generally upwardly from said flange portion and generally toward the edge of said roof deck when said cant member is positioned on said roof deck, and a generally vertical sheet portion turned downwardly from said inclined sheet portion and extending downwardly to a position at least generally adjacent said top surface of said roof deck when said cant member is positioned thereon; and an elongated retainer member adapted to be fastened to said top surface of said roof deck and having securing means for confining the movement of at least said vertical sheet portion of said cant member, wherein said flange portion of said cant member extends inwardly and generally away from the edge of said roof deck when said cant member is positioned on said roof deck and is further adapted to be fastened to said top surface of said roof deck, and wherein said vertical sheet portion of said cant member extends downwardly below said top surface of said roof deck along an outer face surface of said roof deck when said cant member and retainer member are assembled on said roof deck and includes a channel shaped projection extending inwardly for cooperating with said securing means of said retainer member to confine the movement of said vertical sheet portion of said cant member.

* * * * *

UNITED STATES PATENT AND TRADEMARK OFFICE

CERTIFICATE OF CORRECTION

PATENT NO. : 4,488,384

DATED : 12/18/84

INVENTOR(S) : John B. Hickman

It is certified that error appears in the above-identified patent and that said Letters Patent is hereby corrected as shown below:

Column 1, line 13, "description" should be —discussion—
Column 1, line 67, "of" (second occurrence) should be —or—
Column 2, line 12, "illustrated" should be --installed--
Column 2, line 35, "the" should be —a—
Column 2, line 33, FIG. 8 should be a new paragraph
Column 3, line 66, "retrainer" should be —retainer—
Column 5, line 42, after "the" insert —above-mentioned—
Claim 7, line 57, "sad" should be —said—
In References Cited: "3,012,376 12/1961 Reddy et al" should be —3,012,376 2/58 Reddy et al—

Signed and Sealed this

*Second* Day of *July 1985*

[SEAL]

*Attest:*

DONALD J. QUIGG

*Attesting Officer* *Acting Commissioner of Patents and Trademarks*